United States Patent [19]

Merritt

[11] Patent Number: 4,673,036

[45] Date of Patent: Jun. 16, 1987

[54] SIDE POCKET MANDREL

[75] Inventor: David T. Merritt, Frisco, Tex.

[73] Assignee: Otis Engineering Corporation, Dallas, Tex.

[21] Appl. No.: 829,088

[22] Filed: Feb. 13, 1986

[51] Int. Cl.[4] ..... E21B 23/03

[52] U.S. Cl. ..... 166/117.5

[58] Field of Search ..... 166/117.5, 242, 313, 166/114, 115, 386

[56] References Cited

U.S. PATENT DOCUMENTS

| | | | |
|---|---|---|---|
| 2,664,162 | 12/1953 | Howard et al. | 166/117.5 |
| 2,679,904 | 6/1954 | Howard et al. | 166/117.5 |
| 2,828,698 | 4/1958 | Bryan | 166/117.5 |
| 3,224,267 | 12/1965 | Harlan et al. | 166/313 |
| 3,802,503 | 4/1974 | McGinn | 166/117.5 |
| 4,416,330 | 11/1983 | Merritt et al. | 166/117.5 |
| 4,480,686 | 11/1984 | Coussan | 166/117.5 |

FOREIGN PATENT DOCUMENTS

| | | | |
|---|---|---|---|
| 717288 | 2/1980 | U.S.S.R. | 166/242 |

*Primary Examiner*—James A. Leppink
*Assistant Examiner*—Hoang C. Dang
*Attorney, Agent, or Firm*—Albert W. Carroll

[57] ABSTRACT

A side pocket mandrel having deflectors provided by external indentations formed in the wall of the mandrel body and providing corresponding internal protrusions located just above the upper end of the receptacle bore, such protrusions being shaped generally like deflectors and serving the same purposes as deflectors.

13 Claims, 9 Drawing Figures

SIDE POCKET MANDREL

BACKGROUND OF THE INVENTION

1. Field of the Invention

This invention relates to gas lift apparatus and more particularly to side pocket mandrels for use in wells produced by gas lift techniques.

2. Description of the Prior Art

Side pocket mandrels typically have an elongated body with a main bore extended longitudinally therethrough and a receptacle bore extending alongside the main bore and a belly portion above the receptacle bore to provide space for the operation of a kickover tool with which a flow control device is installed in or removed from the receptacle bore. The receptacle bore in most cases is provided with lateral ports which communicate the receptacle bore with the exterior of the side pocket mandrel so that a flow control device placed in the receptacle bore will control the passage of lift gas between the interior of the tubing string in which the side pocket mandrel is connected and the tubing-casing annulus surrounding the tubing string. For some time now, many side pocket mandrels have been equipped with deflectors for protecting the upper end of the receptacle bore and any flow control device disposed therein from damage due to being impacted by well tools passing through the tubing string. The deflectors will cause large ordinary well tools to be deflected back into the main bore of the side pocket mandrel while the smaller diameter tools which are intended to enter the receptacle bore will be guided thereinto by such deflectors. Examples of side pocket mandrels having deflectors are illustrated in the following U.S. Pat. Nos.,

| | | | | |
|---|---|---|---|---|
| 3,268,006 | 3,891,032 | 4,031,954 | 4,106,564 | 4,333,527 |
| 3,741,299 | 3,874,445 | 4,034,806 | 4,197,909 | 4,407,362 |
| 3,796,259 | 4,002,203 | 4,066,128 | 4,201,265 | 4,462,465 |
| 3,802,503 | 4,030,543 | 4,106,563 | 4,239,082 | 4,480,686 |
| 3,807,498 | | | | |

Deflectors normally have been manufactured separately from the side pocket mandrel body and then welded therein either as a part of a receptacle unit or welded directly to the side pocket mandrel body.

U.S. Pat. No. 3,268,006 issued Aug. 23, 1966 to W. J. Hayes and discloses side pocket mandrels having deflectors therein extending upwardly from the upper end of the receptacle bore for some appreciable distance. The deflectors provide a channel which is narrower than the main bore but is sufficiently wide to guide a flow control device or the like into the receptacle bore thereoelow. Tools which are too wide to enter the channel provided by the deflector will be kept clear of the receptacle bore and will be deflected back into the main passage through the side pocket mandrel.

U.S. Pat. No. 3,741,299 which issued June 26, 1973 to Ben D. Terral discloses a type of deflector which is welded into the body of the side pocket mandrel just above the receptacle but adjacent thereto. The receptacle and the deflectors are made separately and then are welded into a window in the wall of the side pocket mandrel body. The deflector provides a channel which will guide smaller tools into the receptacle bore and is provided with an upwardly and outwardly sloping surface for deflecting larger tools away from the receptacle bore and into the main bore. Many other patents show deflectors of the type which have been disclosed in U.S. Pat. No. 3,741,299, and among these are the following U.S. Pat. Nos.:

| | | | | |
|---|---|---|---|---|
| 3,796,259 | 3,802,503 | 3,807,498 | 3,874,445 | 3,891,032 |
| 4,002,203 | 4,030,543 | 4,031,954 | 4,034,806 | 4,106.563 |
| 4,106,564 | 4,197,909 | 4,201,265 | 4,239,082 | 4,480,686 |

U.S. Pat. No. 4,066,128 which issued to Jerry B. Davis and Guy W. Gant on Jan. 3, 1978 discloses deflectors which are welded into the side pocket mandrel just above the receptacle bore to deflect larger tools away from the receptacle bore while guiding smaller tools into the receptacle bore. Similar deflectors are shown in U.S. Pat. Nos. 4,407,362 and 4,462,465.

U.S. Pat. No. 4,197,909 issued Apr. 15, 1980 to Ben D. Terral, and this patent illustrates deflectors which are very similar to those in U.S. Pat. No. 3,741,299 mentioned earlier, and in addition to this, the mandrel body immediately above the upper ends of the deflectors has been provided with a pair of internal button-like projections which will prevent tools from interfering with or lodging atop the upper ends of the deflectors. Sometimes deflectors can be spaced slightly from the inner wall of the mandrel leaving a crack or a crevice therebetween in which tools or wire may become fouled. The internal buttons taught in U.S. Pat. No. 4,197,909 are provided to prevent this from happening. One form of these buttons is illustrated in FIG. 3 of U.S. Pat. No. 4,197,909 and shows that these buttons are formed by making an external indentation in the wall of the mandrel body and causing a corresponding inward projection or button.

U.S. Pat. No. 4,333,527 issued June 8, 1982 to Robert S. Higgins and David T. Merritt, and this patent discloses deflectors which are welded in place within the upper body section of the side pocket mandrel which is then welded by a circumferential weld to the upper end of the lower body section.

Deflectors for side pocket mandrels are of a shape which is costly to manufacture and welding them in place within the mandrel is generally expensive. Sometimes the deflectors have their upper ends spaced slightly from the inner wall of the mandrel, thus leaving a crevice in which tools or wire can lodge and cause trouble. If the deflectors are welded into the mandrel through use of plug welds, these plug welds can become a source of mandrel failure since they may crack due to flexure resulting from differential pressures which may act in one direction or the other, inwardly or outwardly.

None of the prior art patents listed and with which the inventor is familiar shows a side pocket mandrel having deflectors formed in the wall thereof above the receptacle bore providing a channel between them which is narrower than the main bore but wider than the receptacle bore for guiding a flow control device into the receptacle bore and providing upwardly facing inclined deflecting surfaces for deflecting other larger well tools toward the main bore and away from the receptacle bore and any flow control device which may be disposed therein.

SUMMARY OF THE INVENTION

The present invention is directed to a side pocket mandrel having means at its opposite ends for connection into a string of well tubing and having a main flow passage extending longitudinally therethrough, a receptacle bore extending alongside the main bore, a belly extending upwardly from the upper end of the receptacle bore and providing space for operation of a kickover tool used to install a flow control device in or to remove such a device from the receptacle bore, the mandrel body being formed with deflectors in the wall thereof above the upper end of the receptacle bore, the deflectors being spaced apart a distance which will permit flow control devices to be guided therebetween into the upper end of the receptacle bore and yet being spaced close enough together to prevent larger tools from passing therebetween, the deflectors having guide surfaces thereon which serve to deflect the larger tools away from the receptacle bore and back into the main bore of the side pocket mandrel.

One object of this invention, therefore, is to provide an improved side pocket mandrel having deflectors formed integrally with its body rather than being made separately and then welded in place in the body.

Another object of this invention is to provide a side pocket mandrel of the character described in which the deflectors are formed by forging, or similar operation.

Another object of this invention is to provide an improved side pocket mandrel in which the deflectors are formed by forming indentations in the exterior surface of the mandrel wall to cause interior projections or ridges of desired shape to serve as deflectors.

Another object of this invention is to provide a side pocket mandrel formed of upper and lower sections and in which the wall of the upper section is deformed to provide deflectors and this operation is performed before the upper section of the mandrel is welded on to the lower section of the mandrel.

Other objects and advantages will become apparent from reading the description of the invention which follows and from studying the accompanying drawing wherein:

DESCRIPTION OF THE PREFERRED EMBODIMENTS

Figure 1:
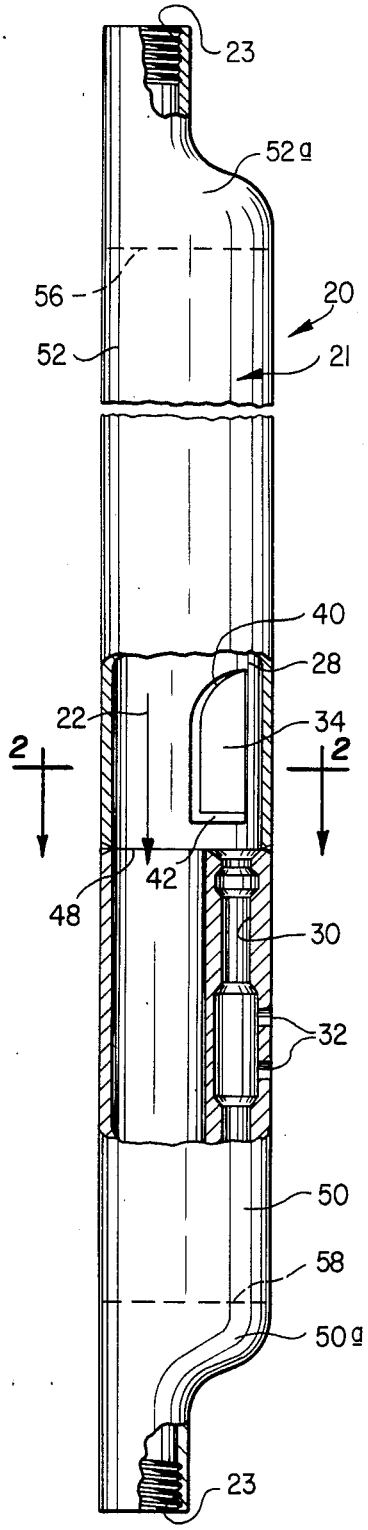
FIG. 1 is a longitudinal view of a side pocket mandrel, partly in elevation and partly in section, showing the body thereof formed with deflectors in accordance with the present invention.

Referring now to FIGS: 1, 2 and 3, it will be seen that the side pocket mandrel 20, much like that seen in U.S. Pat. Nos. 3,741,299, 4,066,128, 4,197,909, and 4,333,527, has an elongate body 21 having a main bore running longitudinally therethrough from end to end. This main bore is indicated by the arrow and the reference numeral 22 applied thereto. It will be seen also that each end of the mandrel is provided with suitable connecting means such as thread 23 by which the side pocket mandrel may be connected into a string of well tubing (not shown) so that the main bore 22 through the mandrel is continuous with the bore of the tubing. The side pocket mandrel 20 is bulged outwardly on the right side as seen in FIG. 1 to provide a belly 28, and there is provided a receptacle bore 30, as shown, which is offset from the main bore 22 and which extends alongside thereof and is adapted to receive a suitable flow control device (not shown) in sealing and locking engagement therewith, all in the usual and well-known manner. Lateral ports 32 are provided in the wall of the receptacle bore to communicate the interior of the side pocket mandrel 20 with the exterior thereof in the conventional manner. Any flow through ports 32 is controlled by a flow control device (not shown) when such device is in position in the receptacle bore 30. The upper end of bore 30 communicates with the interior of the side pocket mandrel as does its lower end although it is not shown. U.S. Pat. Nos. 3,741,299, 4,066,128, 4,197,909 and 4,333,527 are hereby incorporated herein for all purposes by reference thereto.

A well flow control device (not shown) is generally installed in the receptacle bore 30 through use of a suitable kickover tool (not shown) lowered into the well on a string of tools such as wireline tools, or pump-down tools, and the kickover tool is actuated to move the flow control device laterally into alignment with the receptacle bore 30, after which the tools are lowered in order to place the flow control device in the bore 30. This operation is well known in the art.

Deflectors also are well known in the art. They are usually placed immediately above the receptacle bore 30 and generally serve two purposes. One purpose is to deflect larger well tools from the receptacle bore so that they will not lodge thereon or damage the receptacle, or any flow control device positioned therein, and another purpose is to guide flow control devices into the receptacle bore 30 after having been aligned therewith by the kickover tool.

Mandrel 20 is provided with deflectors such as deflectors 34, there being one provided on either side of the receptacle bore thus providing a channel therebetween which is narrower than the main bore but at least as wide as the receptacle bore.

Figure 2:
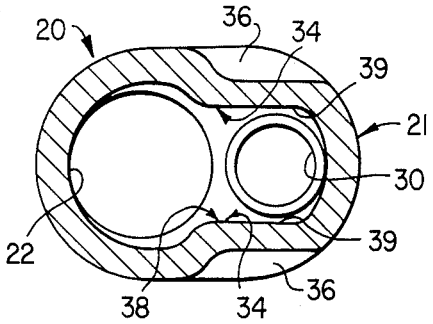
FIG. 2 is a cross-sectional view taken along line 2—2 of FIG. 1.

The deflectors 34 are better seen in FIG. 2 where it will be noticed that each deflector 34 constitutes a ridge-like internal protrusion which is formed by an external indentation 36 formed in the wall of the elongate body 21 as shown. A channel 38 is formed between the opposed faces 39 of the deflectors 34, and this channel is narrower than the main bore 22 but wider than the receptacle bore 30. The opposed faces 39 of the deflectors may be formed flat or non-flat, as desired. The bends at the edges of the deflectors, both on the internal and external surfaces of the mandrel body, are preferably radiused to avoid concentration of stresses. The upper end of deflector 34 as seen in FIG. 1 is formed with an upwardly facing shoulder 40 which is inclined upwardly and outwardly so that large tools engaging the deflectors from above will be deflected back into the main bore 22 and away from the receptacle bore 30. The lower end 42 of the deflector is located a short distance above the upper end of the receptacle bore 30, as shown. The upper end of the deflector may be spaced above the upper end of the receptacle bore 30 by any suitable distance and could extend to the upper end of the belly 28 if desired.

The deflectors 34 may be created by forming external indentations such as indentations 36 in the exterior of the mandrel body 21 by any suitable means such as forging, or the like. The term forging includes forming such indentions with or without heat and with or without dies. Preferably, the identations 36 would be forged through use of a suitable press, such as a hydraulic or mechanical press, while holding the mandrel at suitably high heat to facilitate such forming operation. Also it may be preferable to perform this operation with dies of suitable shape in order to provide deflectors of suitable dimension and shape. In addition, it may be preferable to form these deflectors with a mandrel inside the bore of the side pocket mandrel body in order to maintain the proper internal shape and dimension of the deflectors and proper size of the channel 38 between the deflectors.

In FIG. 2, the side pocket mandrel 20 is shown to be oval in cross section. The side pocket mandrel may, if desired, be formed of circular cross-section material as shown in FIG. 3.

Figure 3:
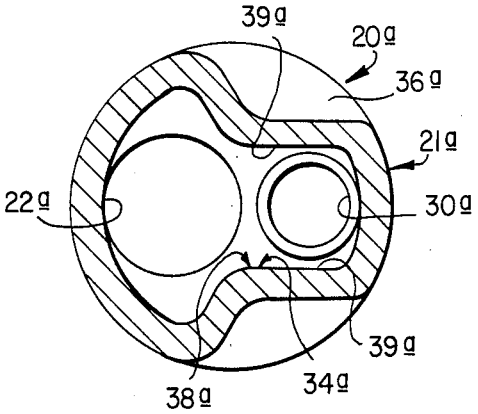
FIG. 3 is a cross-sectional view similar to the cross-sectional view of FIG. 2 but taken through a mandrel of circular section.

In FIG. 3, a round side pocket mandrel is shown and is indicated generally by the reference numeral 20*a*. Mandrel 20*a* is provided with a body 21*a* having deflectors 34*a* formed one on either side of its receptacle bore 30*a* and forming a channel 38*a* therebetween, which channel is narrower than the main bore 22*a* but wider than the receptacle bore 30*a*. Deflectors 34*a* are provided by forming external indentations 36*a* in the wall of side pocket mandrel 20*a*, as shown. Deflectors 34*a* and the channel 38*a* perform the same functions performed by the deflectors 34 and channel 38 in side pocket mandrel 20 previously described.

The body 21 of side pocket mandrel 20 or the body 21*a* of side pocket mandrel 20*a* may be formed in any suitable manner. For instance, the body 21 may be constructed in two pieces if desired and welded together as at 48. The lower body section 50 may be fashioned of a solid block of material and the upper body section 52 may be made from a piece of round or oval tubing somewhat as taught in U.S. Pat. No. 4,333,527, supra. The upper body 52 section would preferably have the deflectors 34 formed therein before the upper and lower body sections 52 and 50 subsequently welded together by the circumferential weld indicated by the numeral 48. The connection 23 at the upper end of the side pocket mandrel could be provided by forging the upper end of the piece 52 to suitable size and shape and then cutting the thread therein, or, alternatively, a transition piece 52*a* can be formed separately and welded as at 56 to the upper end of the body section 52. The thread 23 at the upper end of the mandrel may preferably be cut after welding was completed. Similarly, the extreme lower portion of the side pocket mandrel 20 could be provided by a lower transitional piece 50*a* which may be exactly like transition piece 52*a* and would be welded to the lower end of the lower body section 50 as at 58. The lower threaded connection 23 would then be formed after the assembly of the side pocket mandrel 20 was completed. If desired, the side pocket mandrel 20 could have its body 21 constructed of a single piece of round or oval tubing with its opposite ends swedged down as shown, and these ends then provided with threaded connections such as connections 23. In this case, the receptacle bore 30 would be provided by a separately formed receptacle member which would be placed inside of the body and welded into a window in the wall of the side pocket mandrel in the conventional manner.

Figure 4:
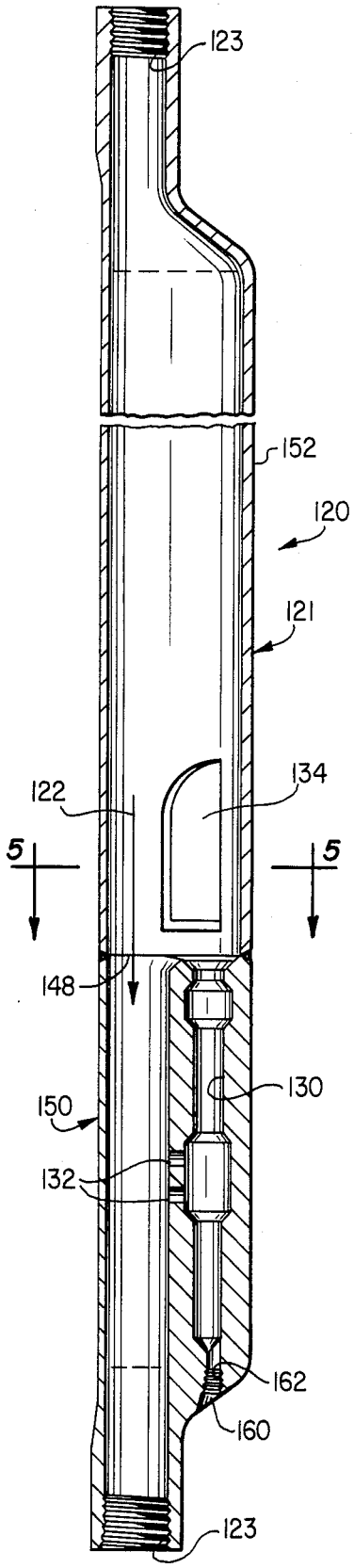
FIG. 4 is a longitudinal sectional view of a modified form of side pocket mandrel.
Figure 5:
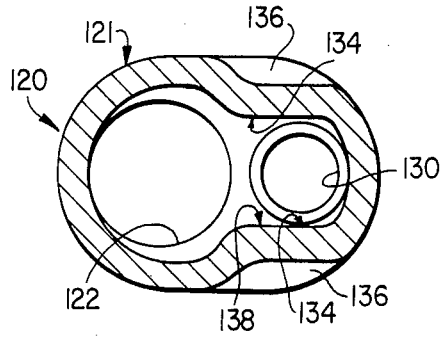
FIG. 5. is a cross-sectional view taken along line 5—5 of FIG. 4.
Figure 6:
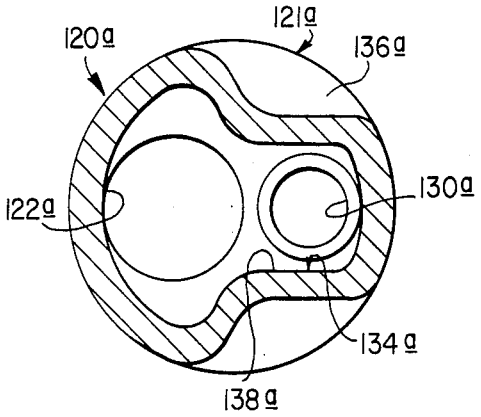
FIG. 6 a cross-sectional view similar to that of FIG. 5 but taken through a round mandrel.

Another form of side pocket mandrel embodying this invention is seen in FIGS. 4, 5, and 6 where the side pocket mandrel is indicated generally by the numeral 120. The mandrel has a body 121 having a main bore 122 extending therethrough from end to end and having a threaded connection 123 at its opposite ends whereby the side pocket mandrel is connectable into a string of well tubing. The mandrel is provided with a receptacle bore 130 which is offset from and extends alongside the main bore 122. The upper body section 152 may, if desired, be made separately from the lower body section 150 and the two body members then welded together with a circumferential weld such as weld 148 after the deflectors 134, which may be exactly like deflectors 34 of mandrel 20, have been formed in the wall of the upper body section 152 by forming external indentations 136, as shown in FIG. 5. Deflectors 134 provide a channel 138 between them which may be exactly like channel 38 of mandrel 20. The side pocket mandrel 120 differs from the side pocket mandrel 20 previously described principally in that the receptacle bore 130 of side pocket mandrel 120 opens at its lower end to the exterior of the side pocket mandrel. This opening is indicated by the numeral 160 and may be threaded as at 162 for attachment of a pipe which may be extended downwardly therefrom as needed. It will be noted that the receptacle 130 is provided with internal lateral flow ports 132 which, in this case, communicate the receptacle bore 130 with the main bore 122 as shown. Thus the side pocket mandrel 120 is equipped for casing flow gas lift operations. In such operations, for instance, a suitable gas lift valve (not shown) is installed in the receptacle 130 and lift gas which is injected into the tubing (not shown) at the surface passes downwardly to the mandrel 120 and through ports 132 into the receptacle bore 130. The lift gas then passes through the gas lift valve and is directed through the opening 160 at the lower end of the receptacle into the tubing-casing annulus to aerate the column of well production fluids between the tubing and casing and thus aid in lifting such fluid to the surface.

If desired, the side pocket mandrel 120 may be provided with external ports (not shown) instead of the internal ports 132. The external ports would be like the ports 32 of mandrel 20 and would communicate the receptacle bore 130 with the tubing-casing annulus exterior of the mandrel in the conventional manner. The side pocket mandrel 120 provided with the external ports as just described would be useful in chamber-lift operations in which the lift gas would be injected into the tubing-casing annulus at the surface and would flow down to the external ports (not shown) in the side pocket mandrel 120, enter therein, and flow through the gas lift valve (not shown) in the receptacle bore 130 to be directed outwardly through the opening 160 at the bottom thereof. A tube or pipe (not shown) attached at thread 162 of port 60 and extending downwardly through a packer would conduct the gas into a chamber therebelow in which well fluids would collect. Gas injected into the chamber in the manner just described would depress the column of well fluids therein and force such fluids upwardly into the tubing string (not shown) and past the side pocket mandrel 120. Well fluids would then be aerated by lift gas entering the tubing from the annulus through separate gas lift valves (not shown) placed in the tubing string at spaced intervals above the side pocket mandrel 120 and thus be lifted to the surface.

If desired, the side pocket mandrel 120 can be constructed in much the same manner as was the side pocket mandrel 20, that is, by forming it in separate sections which are then welded together by circumferential welds.

In FIG. 5, the side pocket mandrel 120 is shown to be oval in cross section. The side pocket mandrel may, if desired, be formed with a circular cross section as shown in FIG. 6.

In FIG. 6, a round side pocket mandrel is shown and is indicated generally by the reference numeral 120*a*. Mandrel 120*a* is provided with a body 121*a* having deflectors 134*a* formed one on either side of its receptacle bore 130*a* and forming a channel 138*a* therebetween, which channel is narrower than the main bore 122*a* but wider than the receptacle bore 130*a*. Deflectors 134*a* are provided by forming external indentations 136*a* in the wall of the side pocket mandrel 120*a* as shown. Deflectors 134*a* and the channel 138*a* perform the same functions performed by the deflectors 34 and channel 38 in side pocket mandrel 20 previously described.

Figure 7:
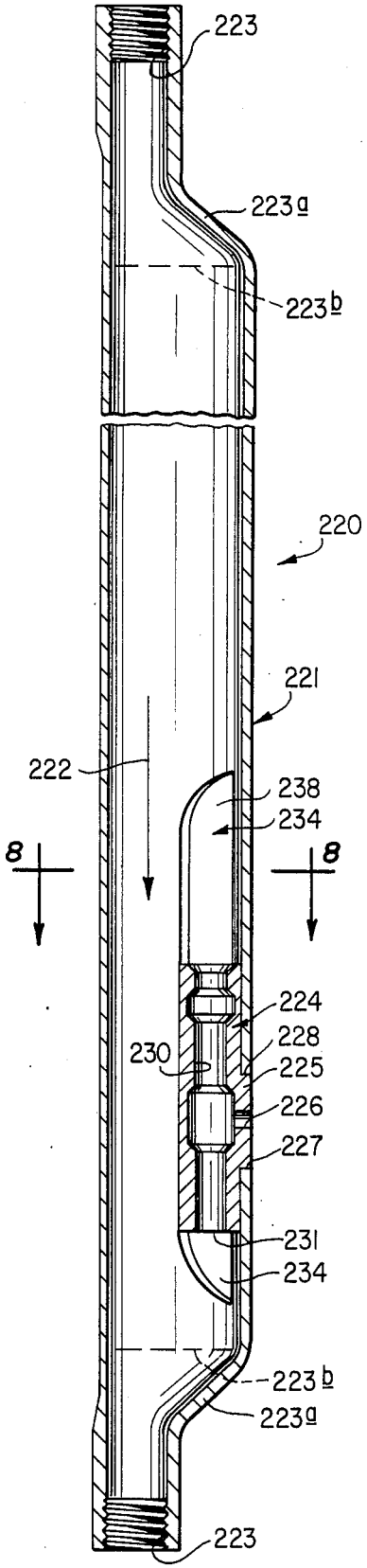
FIG. 7 is a longitudinal sectional view of a further modified form of side pocket mandrel.
Figure 8:
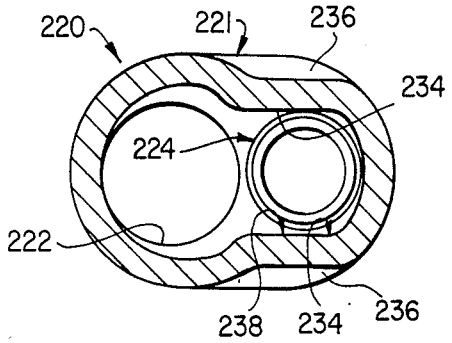
FIG. 8 is a cross-sectional view taken along line 8—8 of FIG. 7.
Figure 9:
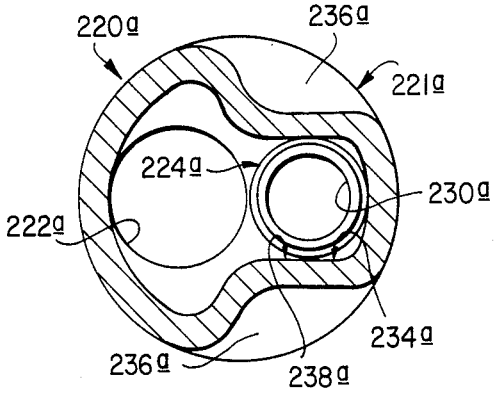
FIG. 9 is a cross-sectional view similar to that of FIG. 8 but showing a section taken through a round mandrel.

Another embodiment of this invention is seen in FIGS. 7, 8, and 9 where the side pocket mandrel is indicated generally by the numeral 220. The side pocket mandrel 220 may be constructed with a one-piece body 221 which may be round or oval in section and which has its opposite ends forged to reduce the size to a suitable dimension preparatory to forming the threaded connections 223 therein on its opposite ends, as shown. Before the opposite ends of the mandrel body 221 are reduced in size however, a pair of external indentations 236 are formed in the exterior surface of the body to provide a pair of internal protuberances 234 which act as deflectors as was explained with respect to the previous embodiments and which provide a channel 238 between them. In the case of side pocket mandrel 220 however, the protuberances or deflectors extend from a suitable distance above the side pocket receptacle 224 to a distance somewhat below the upper end of the receptacle bore 230. In FIG. 8, the body 221 is shown to be oval in shape.

The side pocket receptacle 224 of mandrel 220 is formed separately from the mandrel body 221. As shown, receptacle 224 is formed with a lateral boss 225 having one or more lateral ports 226 in the wall thereof which communicate the receptacle bore 230 with the exterior of the mandrel, as shown. The receptacle 224 is positioned with its boss 225 in a window 227 formed in the mandrel body 221 and is welded in place as by a weld 228 extending completely around the window. Thus, the receptacle 224 becomes an integral part of the side pocket mandrel. The receptacle bore 230 formed in the receptacle is adapted to receive a flow control device (not shown) therein in locked and sealed relation therewith. The lateral port 226 communicates the interior of the mandrel with the exterior thereof as is common in side pocket mandrels.

Lift gas for gas lift operations is injected into the well annulus at the surface, flows down the well between the tubing and casing, passes through the port 226 and through the gas lift valve (not shown) in the receptable bore 230. Upon leaving the gas lift valve, the gas is directed into the tubing through the open lower end 231 of receptacle bore 230 to aerate a column of well fluids rising in the tubing and assists in lifting such well fluids to the surface in the well-known manner.

If desired, transition pieces, such as transition pieces 223*a* may be welded as by circumferential welds 223*b* to the mandrel body 221 as shown, and thus avoid the necessity for forging the ends of the mandrel body 220 to adapt them for receiving the threads 223 at its opposite ends.

In FIG. 8, the side pocket mandrel 220 is shown to be oval in cross section. The side pocket mandrel may, if desired, be formed with a circular cross section as shown in FIG. 9.

In FIG. 9, a round side pocket mandrel is shown and is indicated generally by the reference numeral 220*a*. Mandrel 220*a* is provided with a body 221*a* having deflectors 234*a* formed one on either side of its receptacle bore 230*a* and forming a channel 238*a* therebetween, which channel is narrower than the main bore 222*a* but wider than the receptacle bore 230*a*. Deflectors 234*a* are provided by forming external indentations 236*a* in the wall of the side pocket mandrel 220*a* as shown. Deflectors 234*a* and the channel 238*a* perform the same functions performed by the deflectors 34 and channel 38 in side pocket mandrel 20 previously described.

If desired, any of the mandrels described hereinabove could be made with orienting means therein such as, for instance, that taught in U.S. Pat. No. 4,333,527. Understandably, an orienting sleeve (not shown) could be secured within the mandrel near the upper end thereof in the usual manner for orienting a wireline-type kickover tool (not shown) lowered into the tubing string by wireline tools for the purpose of installing a flow control device in the receptacle 30 or retrieving such a device therefrom. On the other hand, if the mandrel is to be used in pumpdown operations, the orienting sleeve would preferably be placed below the upper end of the receptacle 30 for orienting a pumpdown kickover tool (not shown), and, additionally, the mandrel would further be provided with an internal annular shoulder near its upper end providing a downwardly facing annular shoulder to be engaged by the pumpdown kickover tool for activating the same after it has first been oriented by the orienting sleeve just mentioned.

The deflectors 34, 34*a* of mandrel 20, 20*a* or deflectors 134, 134*a* of mandrel 120, 120*a* or deflectors 234, 234*a* of mandrel 220, 220*a* and the channel formed between them in each case have been shown to serve the same functions as do the deflectors which are provided by other means, but may be provided at low cost. Such deflectors may be readily formed, particularly through use of forging processes. Such deflectors being formed by deforming the wall of the mandrel body do not provide a crack or crevice in which tools or wire can become fouled or broken.

Thus, the side pocket mandrels illustrated and described in this application are well adapted to fulfilling the objects set forth hereinabove. It is understood, however, that variations in the sizes and arrangements of features in these side pocket mandrels and changes in materials and process of forming them may be had without departing from the true spirit of this invention.

I claim:

1. A side pocket mandrel, comprising:

(a) an elongate body connectable in a string of well tubing and having a main bore therethrough and an offset belly portion intermediate its ends;

(b) receptacle means providing a receptacle bore in said elongate body opening upwardly into said belly portion, said receptacle being adapted to receive a flow control device therein in locking and sealing engagement therewith; and (c) said body being formed with a pair of indentations in the external surface of said belly portion of said body providing a corresponding pair of internal deflectors extending upwardly from a point near the upper end of said receptacle bore and being spaced apart to form a keyway-like channel therebetween in alignment with said receptacle bore and being at least as wide as said receptacle bore but narrower than said main bore.

2. The side pocket mandrel of claim 1 wherein said body is made in at least two sections and are welded together after said external indentations have been formed therein.

3. The side pocket mandrel of claim 1 wherein:

(a) said indentations extend downwardly below the upper end of said receptacle means; and (b) said receptacle means is made separately and welded into said elongate body.

4. The side pocket mandrel of claim 1, 2, or 3, wherein said elongate body is of generally circular cross-section.

5. The side pocket mandrel of claim 4, wherein said indentations are formed in the exterior of said elongate body as by forging.

6. The side pocket mandrel of claim 1, 2, or 3, wherein said elongate body is generally of non-circular cross-section.

7. The side pocket mandrel of claim 6, wherein said indentations are formed in the exterior of said elongate body as by forging.

8. The side pocket mandrel of claim 1, 2, or 3 wherein said elongate body is of generally oval cross-section.

9. The side pocket mandrel of claim 8, wherein said indentations are formed in the exterior of said elongate body as by forging.

10. The side pocket mandrel of claim 1, 2, or 3, wherein said indentations are formed in the of said elongate body as by forging.

11. A side pocket mandrel, comprising:

a. a lower body section having a main bore therethrough, a receptacle bore extending alongside said main bore, and lateral port means in the wall of said receptacle bore, said lower body section having means for connecting its lower end to a tubing string; and b. an upper body section welded to the upper end of said lower body section, said upper body section having a main passage therethrough in alignment with said main bore of said lower body section and having an offset belly therein in alignment with said receptacle bore, said upper body section being formed with a pair of indentations in its external surface providing a pair of corresponding internal deflectors extending upwardly from a point near the upper end of said receptacle bore and being spaced apart to form a keyway-like channel therebetween in alignment with said receptacle bore and being at least as wide as said receptacle bore but narrower than said main bore, said upper body section having means for connecting its upper end to a tubing string.

12. The side pocket mandrel of claim 11 wherein said deflectors are formed in said upper body section before said upper body secton is welded to said lower body section.

13. The side pocket mandrel of claim 11 or 12 wherein said deflectors are formed as by forging.

* * * * *